US007313522B2

(12) United States Patent
Fukuzato

(10) Patent No.: US 7,313,522 B2
(45) Date of Patent: Dec. 25, 2007

(54) VOICE SYNTHESIS SYSTEM AND METHOD THAT PERFORMS VOICE SYNTHESIS OF TEXT DATA PROVIDED BY A PORTABLE TERMINAL

(75) Inventor: Atsushi Fukuzato, Tokyo (JP)

(73) Assignee: NEC Corporation, Tokyo (JP)

( * ) Notice: Subject to any disclaimer, the term of this patent is extended or adjusted under 35 U.S.C. 154(b) by 819 days.

(21) Appl. No.: 10/270,310

(22) Filed: Oct. 15, 2002

(65) Prior Publication Data

US 2003/0088419 A1 May 8, 2003

(30) Foreign Application Priority Data

Nov. 2, 2001 (JP) ..... 2001-337617

(51) Int. Cl.
*G10L 13/00* (2006.01)

(52) U.S. Cl. ..... 704/258; 379/88.01; 379/88.02

(58) Field of Classification Search ..... 704/258; 379/88.01–88.04

See application file for complete search history.

(56) References Cited

U.S. PATENT DOCUMENTS

| | | | | |
|---|---|---|---|---|
| 5,721,827 | A * | 2/1998 | Logan et al. | 709/217 |
| 5,842,167 | A | 11/1998 | Miyatake et al. | |
| 5,899,975 | A | 5/1999 | Nielsen | |
| 5,940,796 | A * | 8/1999 | Matsumoto | 704/260 |
| 5,950,163 | A * | 9/1999 | Matsumoto | 704/260 |
| 6,144,938 | A * | 11/2000 | Surace et al. | 704/257 |
| 6,289,085 | B1 * | 9/2001 | Miyashita et al. | 379/88.02 |
| 6,369,821 | B2 * | 4/2002 | Merrill et al. | 345/473 |
| 6,453,281 | B1 * | 9/2002 | Walters et al. | 704/200 |
| 6,625,576 | B2 * | 9/2003 | Kochanski et al. | 704/260 |
| 6,980,834 | B2 * | 12/2005 | Gupta et al. | 455/563 |
| 2002/0169610 | A1 | 11/2002 | Luegger | |

FOREIGN PATENT DOCUMENTS

| | | |
|---|---|---|
| EP | 1 248 251 A2 | 10/2002 |
| GB | 2 373 141 A | 9/2002 |
| GB | 2 376 610 A | 12/2002 |
| JP | 4-175049 | 6/1992 |
| JP | 08-328575 | 12/1996 |
| JP | 09-050286 | 2/1997 |
| JP | 11-109991 | 4/1999 |
| JP | 11-308270 | 11/1999 |
| JP | 2000-020417 | 1/2000 |
| JP | 2000-112845 | 4/2000 |
| JP | 2000-339137 | 8/2000 |
| JP | 2001-022371 | 1/2001 |
| JP | 2001-195080 | 7/2001 |
| JP | 2001-222292 | 8/2001 |
| JP | 2001-255884 | 9/2001 |
| WO | WO 02/49003 A1 | 6/2002 |
| WO | WO 2003/063133 A1 | 7/2003 |

* cited by examiner

*Primary Examiner*—Michael Opsasnick
(74) *Attorney, Agent, or Firm*—Foley & Lardner LLP

(57) ABSTRACT

A system for providing a particular voice to a received e-mail includes a portable terminal and a server. The portable terminal attaches a voice sampling name to the text data and transmits it to a server. The server receives the text data and the voice sampling name from the portable terminal, converts the received text data into voice synthesis data by using voice sampling data corresponding to the voice sampling name, and transmits the voice synthesis data to the portable terminal.

5 Claims, 9 Drawing Sheets

VOICE SYNTHESIS SYSTEM AND METHOD THAT PERFORMS VOICE SYNTHESIS OF TEXT DATA PROVIDED BY A PORTABLE TERMINAL

FIELD OF THE INVENTION

The present invention relates to a voice synthesis system which is provided with a portable terminal and a server which are connectable to each other via a communication line. More particularly, the present invention relates to a voice synthesis system, in which text data transmitted from the portable terminal to the server is converted into voice synthesis data by the server and transmitted back to the portable terminal.

BACKGROUND OF THE INVENTION

Recent popularization of internet connection services for cellular phones such as "i-mode" (trade mark) has increased the amount of information distribution in text data. In addition to exchanging e-mails, various services such as mobile banking, online trading and ticket purchasing became available for cellular phones.

On the other hand, information in text data has the following drawbacks: (1) information on a small screen of a cellular phone is hard to read, especially for aged people; and (2) such information is useless for sight disabled people.

Therefore, a cellular phone that has a function of reading out the text data has been suggested. For example, with a cellular phone described in Japanese Patent Laid-Open Application No. 2000-339137, a user can select one of predetermined voice data categories (e.g., man, woman, aged or child) so that text data is converted in a voice based on the selected voice data.

However, the cellular phone described in the above-described document causes incongruous feeling to the user since the voice synthesis data is reproduced in a voice different from that of the person who sent the text data.

SUMMARY OF THE INVENTION

Thus, the present invention has an objective of providing a voice synthesis system and a voice synthesis method to enhance reality.

transmitting the converted voice synthesis data to the portable terminal.

A voice synthesis system according to present invention comprising a portable terminal and a server which are connectable to each other via a communication line. And the portable terminal comprises a text data receiving unit for receiving text data, a text data transmitting unit for attaching a voice-sampling name to the received text data and transmitting the text data to the server, a voice synthesis data receiving unit for receiving the voice synthesis data from the server and a voice reproducing unit for reproducing the received voice synthesis data in a voice. And the server comprises a text data receiving unit for receiving the text data and the voice sampling name from the portable terminal, a voice synthesizing unit for converting the received text data into voice synthesis data by using voice sampling data corresponding to the received voice sampling name and a voice synthesis data transmitting unit for transmitting the converted voice synthesis data to the portable terminal.

A voice synthesis system according to present invention, wherein there are a plurality of portable terminals.

A voice synthesis system according to present invention, wherein each of the portable terminals further comprises a voice sampling data collecting unit for collecting voice sampling data of each user, and a voice sampling data transmitting unit for transmitting the collected voice sampling data to the server. And the server further comprises a voice sampling data receiving unit for receiving the voice sampling data from each of the portable terminals, and a database constructing unit for attaching the voice sampling name to the received voice sampling data to construct a database.

The voice synthesis method of the present invention is a method employed in the voice synthesis system of the invention.

In other words, the present invention uses data protocol between a JAVA application and a communication system host terminal so as to synthesize received text data into voice data and reproduce it on a cellular phone. Furthermore, voice sampling data to be used for voice synthesis in the data protocol can be specified to output desired voice synthesis data. Voice sampling data of a user may be collected upon conversation by the user over the portable terminal, and may then be delivered to other users.

Moreover, the present invention is a system for reproducing voice synthesis data by using the JAVA application of the portable terminal, and has the following features: (1) has unique data protocol between the portable terminal and the communication host terminal; (2) receives and automatically reproduces voice synthesis data; (3) converts text data into voice data at the communication system host terminal based on the voice sampling data, thereby generating voice synthesis data; (4) collects voice sampling data upon conversation by the user over the cellular phone to produce a database of voice sampling data characteristic of the user; and (5) provides unit for making the produced database of the user accessible to other users.

DETAILED DESCRIPTION OF THE INVENTION

Figure 1:
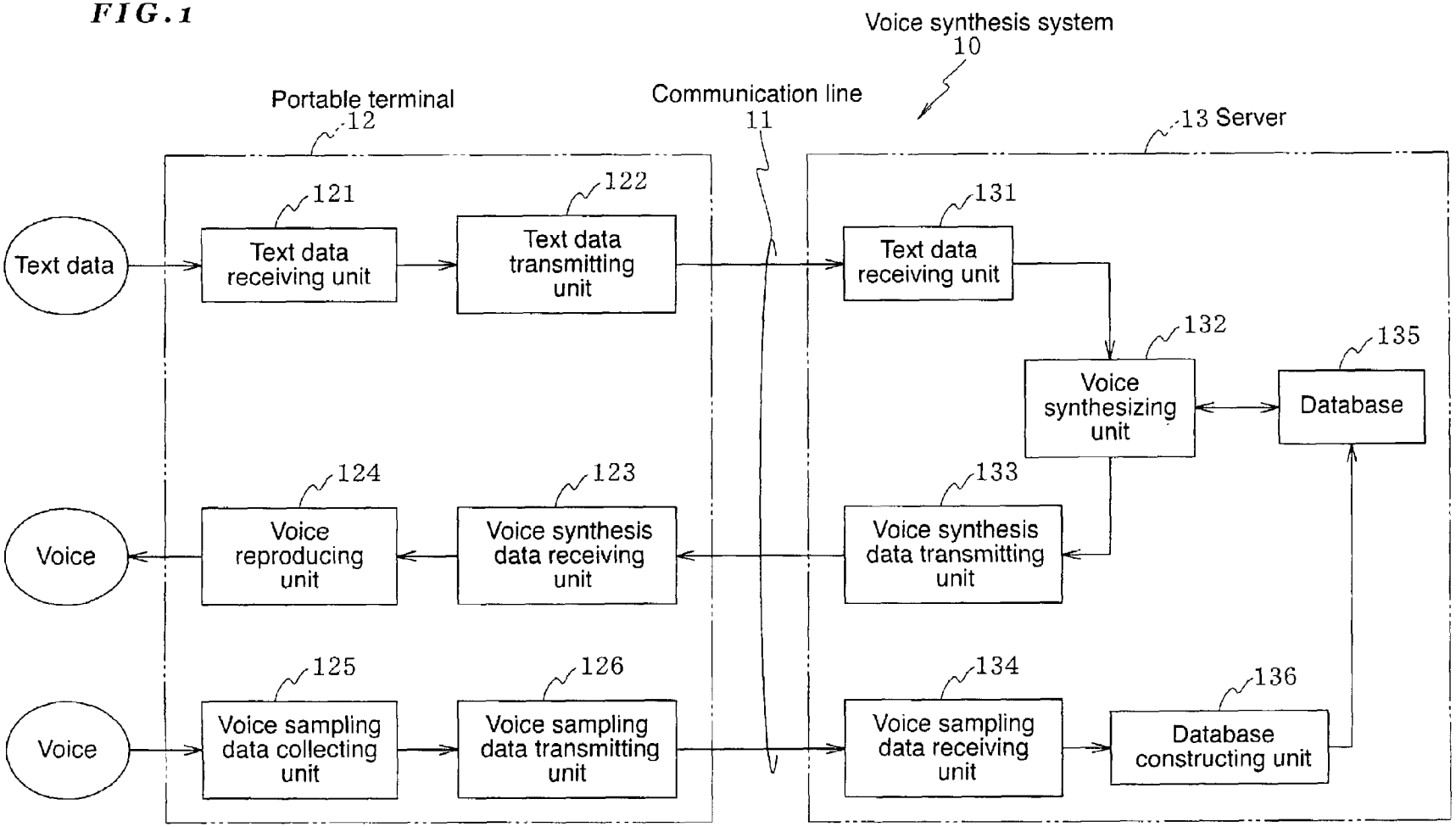
FIG. 1 is a block diagram showing functions of one embodiment of the voice synthesis system according to the present invention.

FIG. 1 is a block diagram showing functions of one embodiment of the voice synthesis system according to the present invention. Hereinafter, this embodiment will be described with reference to this figure. An embodiment of the voice synthesis method of the invention will also be described.

A voice synthesis system 10 according to the present embodiment is provided with a portable terminal 12 and a server 13 which are connectable to each other via a communication line 11. Although only one portable terminal 12 is shown, a plurality of portable terminals 12 are actually provided.

Each of the portable terminals 12 is provided with a text data receiving unit 121 for receiving text data, a text data transmitting unit 122 for attaching a voice sampling name to the received text data and transmitting it to the server 13, a voice synthesis data receiving unit 123 for receiving the voice synthesis data from the server 13, a voice reproducing unit 124 for reproducing the received voice synthesis data in a voice, a voice sampling data collecting unit 125 for collecting voice sampling data of the user of the portable terminal 12, and a voice sampling data transmitting unit 126 for transmitting the collected voice sampling data to the server 13.

The server 13 is provided with a text data receiving unit 131 for receiving the text data and the voice sampling name, a voice synthesizing unit 132 for converting the received text data into voice synthesis data by using the voice sampling data corresponding to the received voice sampling name, a voice synthesis data transmitting unit 133 for transmitting the converted voice synthesis data to the portable terminal 12, a voice sampling data receiving unit 134 for receiving the voice sampling data from the portable terminal 12, and a database constructing unit 136 for naming the received voice sampling data and constructing a database 135.

The communication line 11 may be, for example, a telephone line or the internet. The portable terminal 12 may be a cellular phone or a personal digital assistance (PDA) integrating a computer. The server 13 may be a computer such as a personal computer. Each of the above-described unit provided for the portable terminal 12 and the server 13 is realized by a computer program. Data is transmitted and/or received via a hardware such as a transmitter/receiver (not shown) and the communication line 11.

Figure 2:
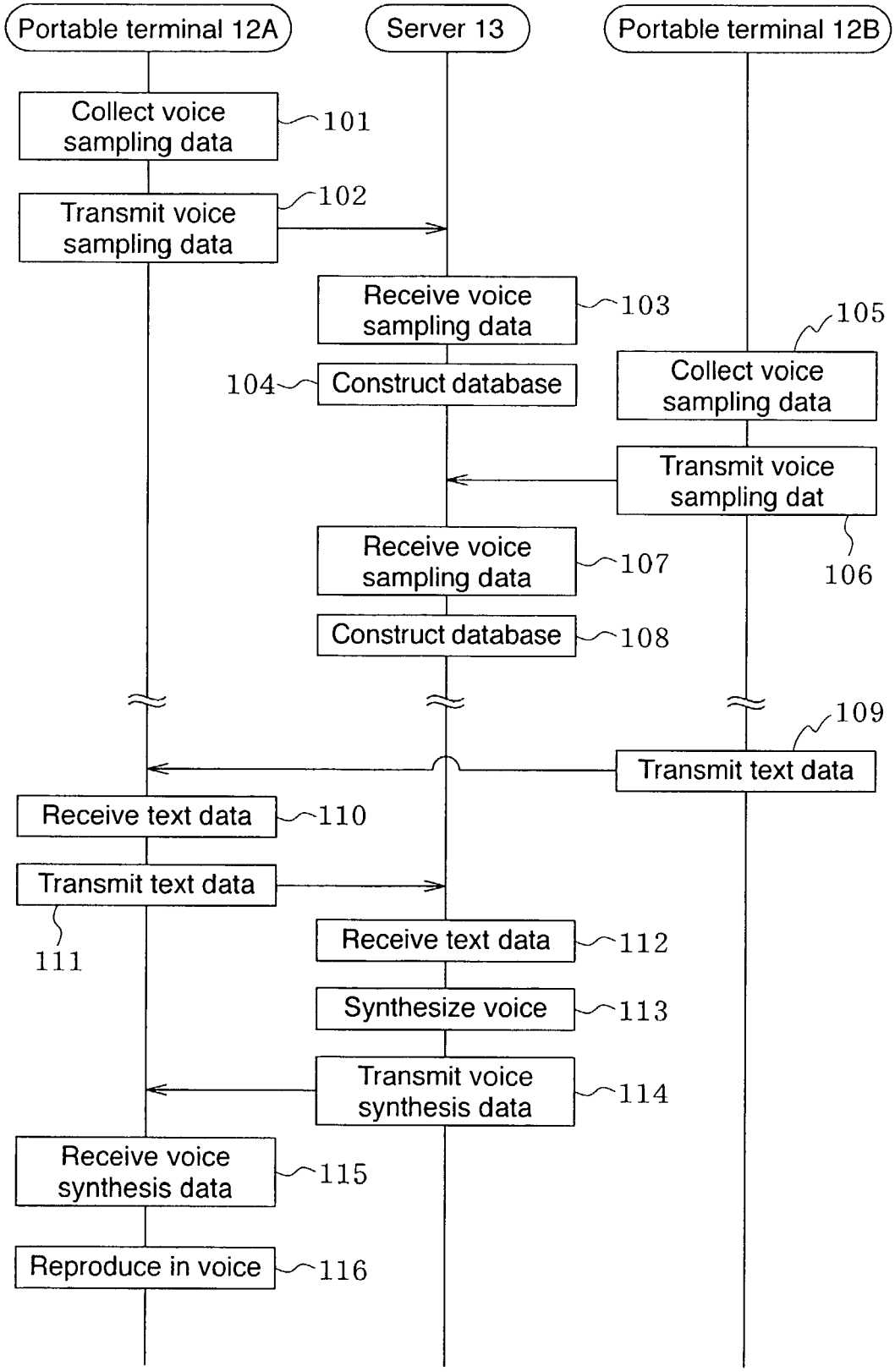
FIG. 2 is a sequence diagram showing exemplary operation of the voice synthesis system shown in FIG. 1.

FIG. 2 is a sequence diagram showing exemplary operation of the voice synthesis system 10. Hereinafter, this operation will be described with reference to FIGS. 1 and 2. Each of portable terminals 12A and 12B has an identical structure to that of the portable terminal 12.

First, in the portable terminal 12A, voice sampling data a of a user A is collected with the voice sampling data collecting unit 125 (Step 101), which is then transmitted by the voice sampling data transmitting unit 126 to the server 13 (Step 102). The voice sampling data receiving unit 134 of the server 13 receives the voice sampling data a (Step 103), and the database constructing unit 136 attaches a voice sampling name A' to the voice sampling data a to construct a database 135 (Step 104). Similarly, in the portable terminal 12B, voice sampling data b of a user B is collected (Step 105) and then transmitted to the server 13 (Step 106). The server 13 receives the voice sampling data b (Step 107), and attaches a voice sampling name B' to the voice sampling data b to construct a database 135 (Step 108).

When the text data receiving unit 121 of the portable terminal 12A receives text data b1 transmitted from the portable terminal 12B (Steps 109, 110), the text data transmitting unit 122 attaches the voice sampling name B' to the text data b1 and transmits it to the server 13 (Step 111). Then, the text data receiving unit 131 of the server 13 receives the text data b1 and the voice sampling name B' (Step 112). The voice synthesizing unit 132 uses the voice sampling data b corresponding to the voice sampling name B' to convert the text data b1 into voice synthesis data b2 (Step 113). The voice synthesis data transmitting unit 133 transmits the voice synthesis data b2 to the portable terminal 12A (Step 114), and the voice synthesis data receiving unit 123 of the portable terminal 12A receives the voice synthesis data b2 (Step 115). Then, the voice reproducing unit 124 reproduces the voice synthesis data b2 in a voice b3 (Step 116).

According to the voice synthesis system 10, the server 13 stores the databases of the voice sampling data a and b of the users A and B of the portable terminals 12A and 12B. Therefore, when the text data b1 from the portable terminal 12B is transmitted from the portable terminal 12A to the server 13, the server 13 returns the voice synthesis data b2 consisting of the voice of the user B of the portable terminal 12B, whereby the text data b1 can be read out in the voice of the user B. As a result, reality can be further enhanced.

Each of portable terminals 12A, 12B, . . . collects and transmits voice sampling data a, b, . . . of user A, B, . . . to the server 13, which, in turn, stores the voice sampling data a, b . . . as databases, thereby automatically and easily expanding the voice synthesis system 10. For example, a user C of a new portable terminal 12C can join the voice synthesis system 10 and immediately enjoy the above-described services.

The voice sampling data collecting unit 125, the voice sampling data transmitting unit 126, the voice sampling data receiving unit 134 and the database constructing unit 136 may be omitted. In this case, the database 135 needs to be built by other unit.

Studies concerning individual voices have been conducted primarily with respect to spectrum and pitch frequency. As studies concerning change in the pitch frequency during time course or average pitch frequency, for example, the effect of prosodic information (e.g., change in the pitch frequency during time course) on language recognition, extraction and control of individual change in pitch frequency during time course by three-mora words have been reported. On the other hand, as to studies concerning spectrum, the relationship between vocal tract characteristic and individuality based on formant frequencies and band widths, and the analysis of individuality with respect to spectrum envelope component of monophthongs have been reported.

EXAMPLE

Hereinafter, a more specific example of the voice synthesis system 10 will be described.

Figure 3:
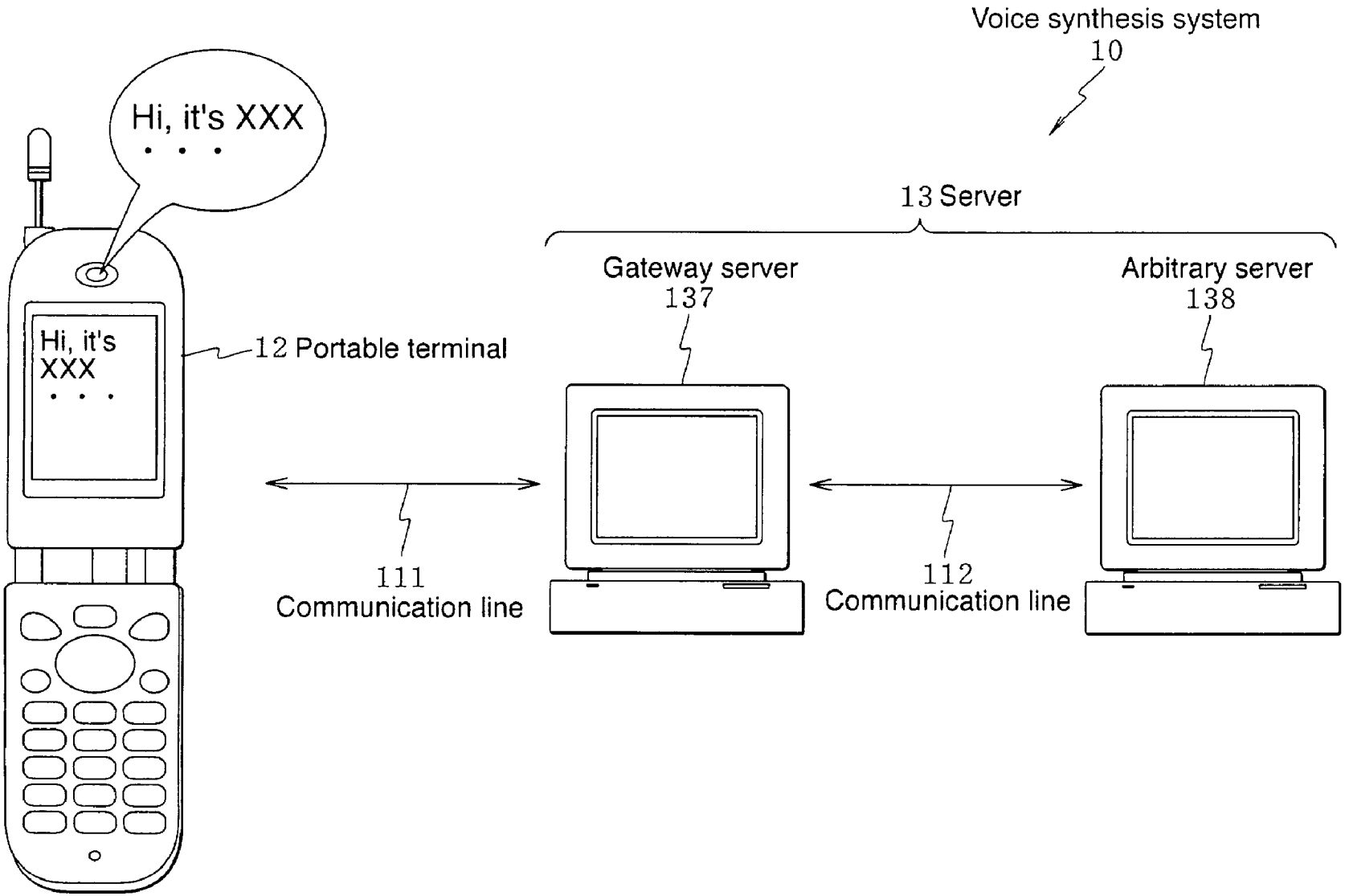
FIG. 3 is a schematic diagram showing one example of the voice synthesis system according to the present invention.

FIG. 3 is a schematic view showing a structure of the voice synthesis system according to the present example.

Only one portable terminal 12 of a plurality of packet information receiving terminals is shown. A server 13 includes a gateway server 137 and an arbitrary server 138.

The portable terminal 12 and the gateway server 137 are connected via a communication line 111 while the gateway server 137 and the server 138 are connected via a communication line 112. A communication request from the portable terminal 12 is transmitted to the arbitrary server 138 as relayed by the gateway server 137, in response to which the arbitrary server 138 transmits information to the portable terminal 12 via the gateway server 137.

Figure 4A:
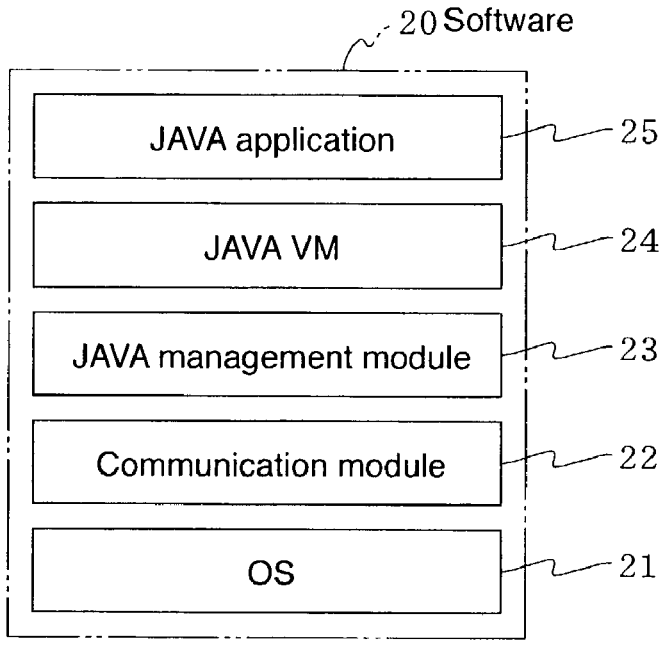
FIG. 4A is a block diagram showing an exemplary configuration of a software of the portable terminal shown in FIG. 3.
Figure 4B:
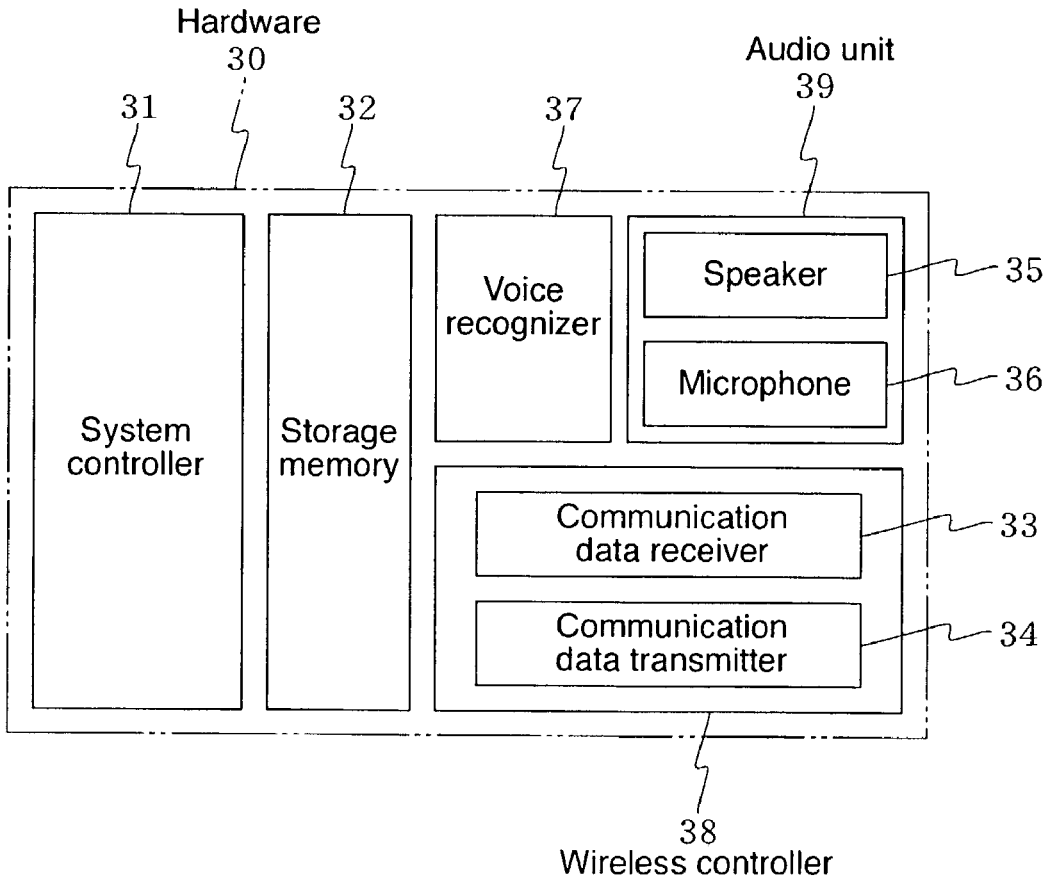
FIG. 4B is a block diagram showing an exemplary configuration of a hardware of the portable terminal shown in FIG. 3.

The portable terminal 12 receives the information from the server 13 and sends an information to the server 13. The gateway server 137 is placed at a relay point between the portable terminal 12 and the arbitrary server 138 to transfer response information to the portable terminal 12. The arbitrary server 138 returns appropriate data in response to the information request transmitted from the portable terminal 12 for automatic PUSH delivery to the portable terminal 12. FIG. 4A is a block diagram showing a configuration of a software of the portable terminal 12. FIG. 4B is a block diagram showing a configuration of a hardware of the portable terminal 12. Hereinafter, these software and hardware will be described with reference to FIG. 3 and FIGS. 4A and 4B.

As shown in FIG. 4A, the software 20 of the portable terminal 12 has a five-layer configuration including OS21, a communication module 22, a JAVA management module 23, a JAVA VM (Virtual Machine) 24 and a JAVA application 25. "JAVA" is one type of object-oriented programming languages. The layer referred to as JAVA VM absorbs the difference among Oss and CPUs and enables execution under any environment with a single binary application.

OS 21 represents a platform. Since JAVA has a merit of not being dependent on the platform, OS 21 is not particularly specified. The communication module 22 is a module for transmitting and receiving packet communication data. The JAVA management module 23, the JAVA VM 24 and the JAVA application 25 recognize that the packet data has been received via the communication module 22. The JAVA management module 23 manages control, for example, of the operation of the JAVA VM 24. The JAVA management module 23 controls the behavior of the JAVA application 25 on the actual portable terminal 12. The functions of the JAVA VM 24 are not particularly defined. However, JAVA VMs incorporated in current personal computers and the like will lack memory capacity if it is directly mounted in the portable terminal 12. Thus, the JAVA VM 24 has only functions that are necessary for the use of the portable terminal 12. The JAVA application 25 is an application program produced to operate based on the data received by the communication module 22.

As shown in FIG. 4B, the hardware 30 of the portable terminal 12 is provided with a system controller 31, a storage memory 32, a voice recognizer 37, a wireless controller 38 and and an audio unit 39. The wireless controller 38 is provided with a communication data receiver 33 and a communication data transmitter 34. The audio unit 39 is provided with a speaker 35 and a microphone 36.

The system controller 31 takes control of the main operation of the portable terminal 12 and realizes each unit of the portable terminal 12 shown in FIG. 1 with a computer program. The storage memory 32 may be used as a region for storing the voice sampling data collected with the JAVA application 25 or as a region for storing voice synthesis data acquired from the server 13. The communication data receiver 33 receives the communication data input into the portable terminal 12. The communication data transmitter 34 outputs the communication data from the portable terminal 12. The speaker 35 externally outputs the received voice synthesis data as a voice. The microphone 36 inputs the voice of the user into the portable terminal 12. The voice recognizer 37 recognizes the voice data input from the microphone 36 and notifies the JAVA application 25.

Hereinafter, exemplary operation of the voice synthesis system according to the present example will be described with reference to FIGS. 5 to 9. Hereinafter, "databases" are provided for individual users of the portable terminals and are not accessible by other users without the permission of the user.

Figure 5:
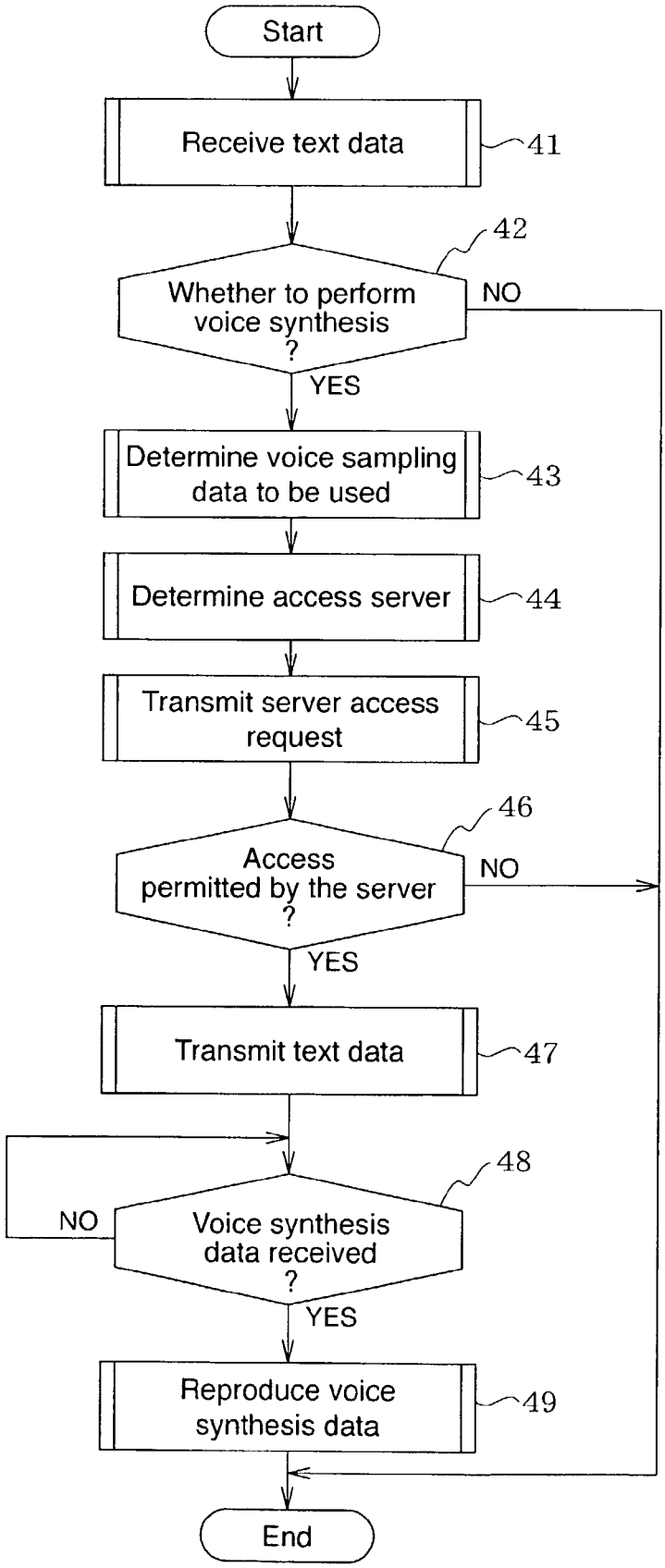
FIG. 5 is a flowchart showing operation of the portable terminal upon receiving text data in the voice synthesis system shown in FIG. 3.

FIG. 5 is a flowchart of the operation of the portable terminal upon receiving text data. This operation is described with reference to this figure.

First, text data is received (Step 41), and whether or not voice synthesis should take place is judged (Step 42). The judgment is made according to selection by the user or according to predetermined data (e.g., to perform or not to perform voice synthesis). When voice synthesis is to be carried out, voice sampling data to be used for the voice synthesis is determined (Step 43). The determination of the sampling data unit to determine between the use of the voice sampling data stored in the database of the portable terminal of the user or the use of the voice sampling data stored in the database of other user. Accordingly, not only the voice sampling data possessed by the user but also the voice sampling data possessed by other users can be referred to reproduce voice synthesis data on the user's portable terminal. When accessing the database of the server, access permission needs to be acquired by using a unique access identifier. When accessing the database of other user, database reference permission should be required as described later with reference to FIGS. 8 and 9.

After determining the sampling data to be used, an access request is made to the database storing the voice sampling data (Steps 44, 45). The sequences of the server and the portable terminal upon access are described later with reference to FIG. 6. When access to the database is permitted, text data is transmitted for voice synthesis (Steps 46, 47). The voice synthesis data delivered from the server is received by the portable terminal (Step 48). Thus, the received voice synthesis data can be reproduced (Step 49).

Figure 6:
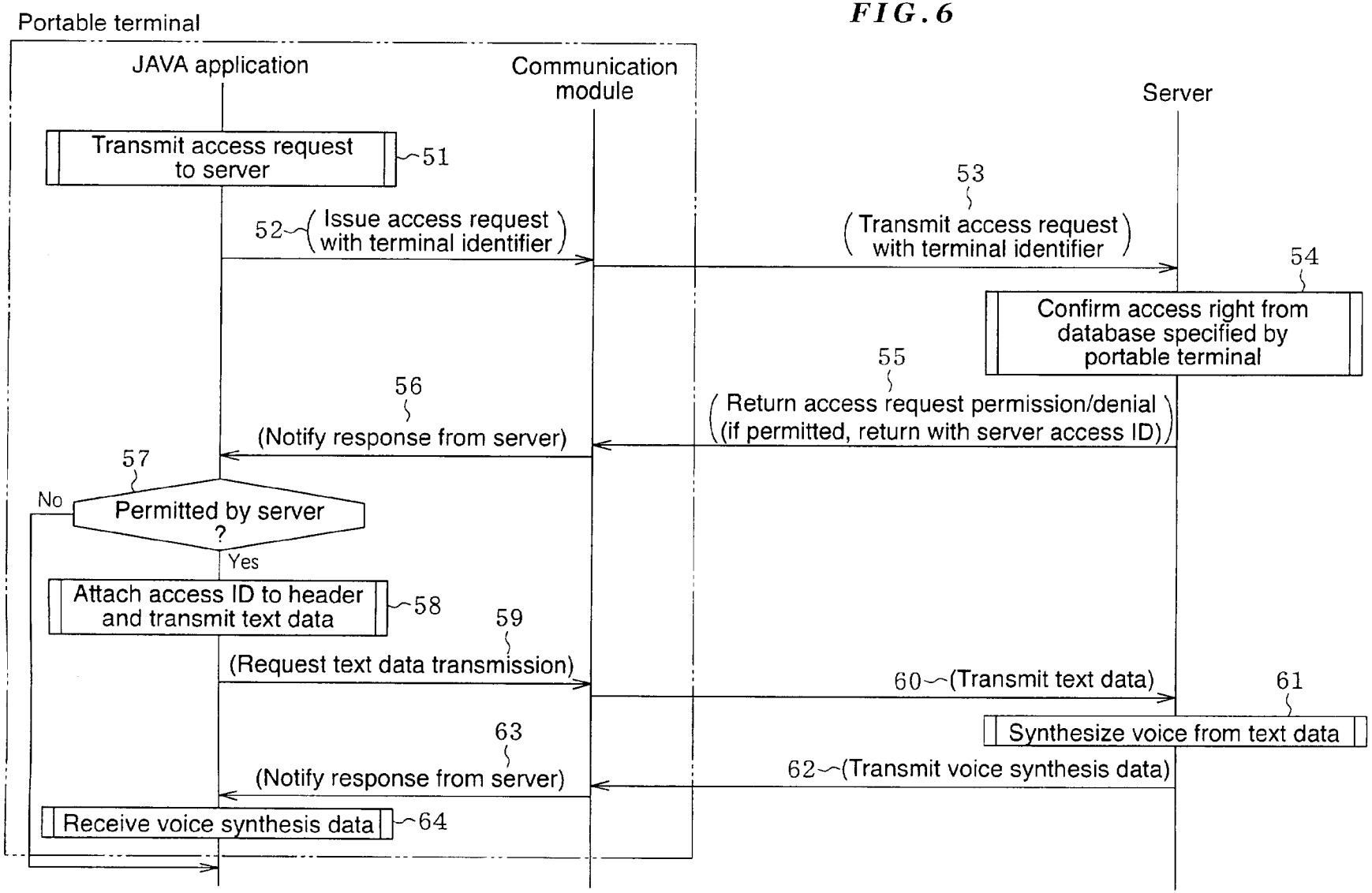
FIG. 6 is a sequence diagram showing operation of the portable terminal to access to the server in the voice synthesis system shown in FIG. 3.

FIG. 6 is a sequence diagram showing operation of the portable terminal to access to the server. This operation will be described with reference to this figure.

First, the portable terminal sends a database reference request together with an access identifier of the portable terminal to the server (Steps 51 to 53). In response to the request, the server searches the database of the server to judge whether the user is qualified for the access (Step 54). If the user is qualified for the access, the server transmits an access ID to the portable terminal so that from the next time the server is able to permit reference of the database by simply confirming this access ID in the header information transmitted from the portable terminal. In other words, when access to the database is permitted, an access ID is delivered from the server to the portable terminal (Step 55). Given the access ID from the server, the portable terminal inputs the access ID as well as the access identifier into the header of the data, and transmits the text data for voice synthesis (Steps 56 to 60).

The server checks access permission of the user by identifying the access ID, and then initiates voice synthesis of the received text data (Step 61). The voice sampling data used for this voice synthesis is acquired from the specified database based on the access ID. Subsequent to the voice synthesis, the server delivers the voice synthesis data to the portable terminal (Step 62). The portable terminal then notifies the JAVA application that data has been received and gives the voice synthesis data to the JAVA application (Step 63). By this operation, the JAVA application recognizes that the voice synthesis data has been received and reproduces the received voice synthesis data (Step 64).

Figure 7:
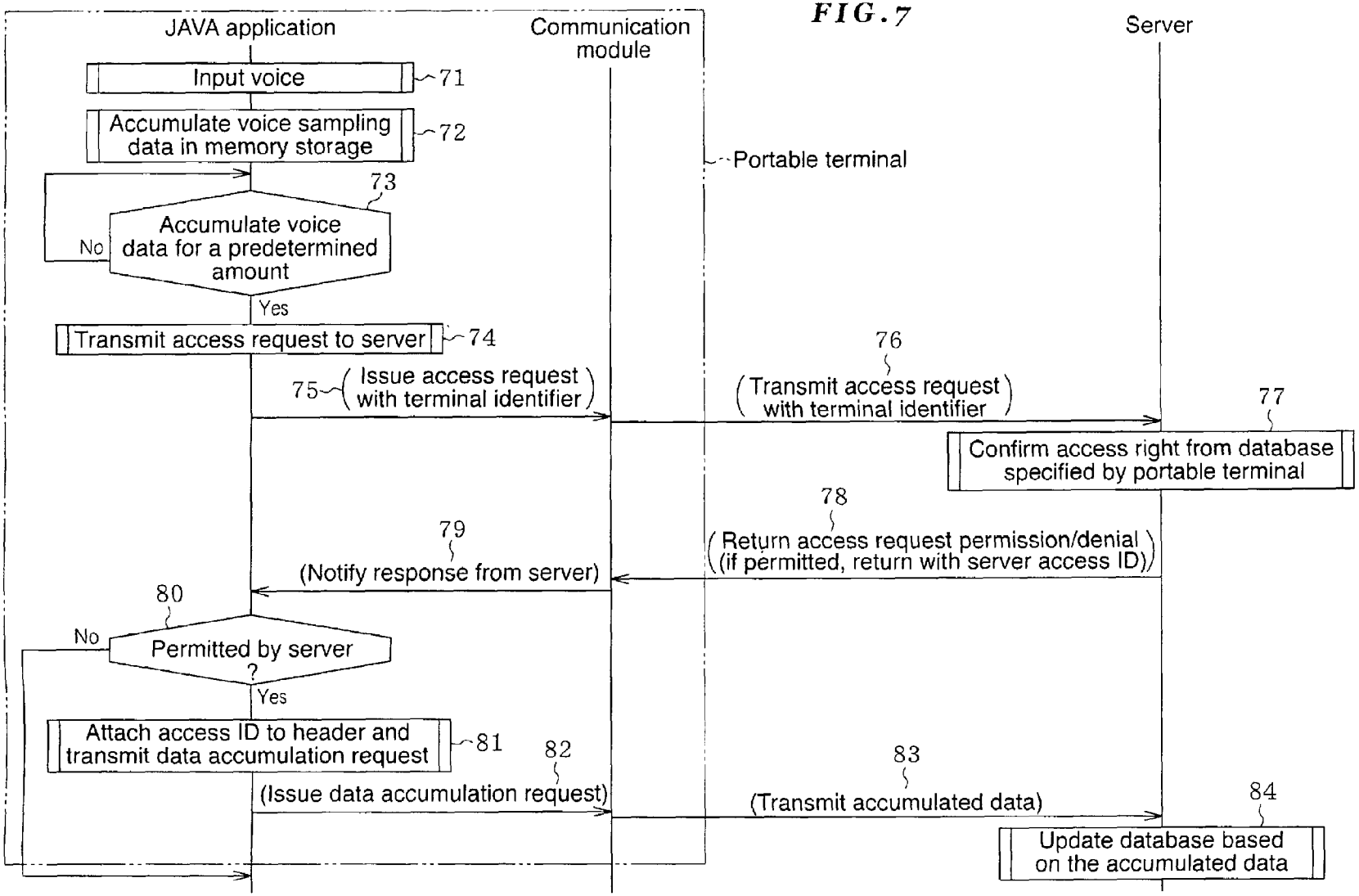
FIG. 7 is a sequence diagram showing operation for producing a database of voice sampling data in the voice synthesis system shown in FIG. 3.

FIG. 7 is a sequence diagram showing operation for producing a database of the voice sampling data. This operation will be described with reference to this figure.

First, while the JAVA application is activating, voice data input into the microphone of the portable terminal during conversation by the user is given to the JAVA application as voice sampling data (Step 71). This voice sampling data is accumulated in the storage medium of the portable terminal (Step 72). When a certain amount of the voice sampling data is accumulated in the storage medium (Step 73), the JAVA application automatically follows the server access sequence shown in FIG. 6 (see Steps 51 to 61 in FIG. 6), and stores the voice sampling data in the storage memory in its own database (Steps 74 to 84). Accordingly, the user can build his/her voice sampling data as a database in the server, and make his/her voice sampling data accessible to other users so that voice synthesis data can be reproduced in his/her own voice on a portable terminal of other user.

Figure 8:
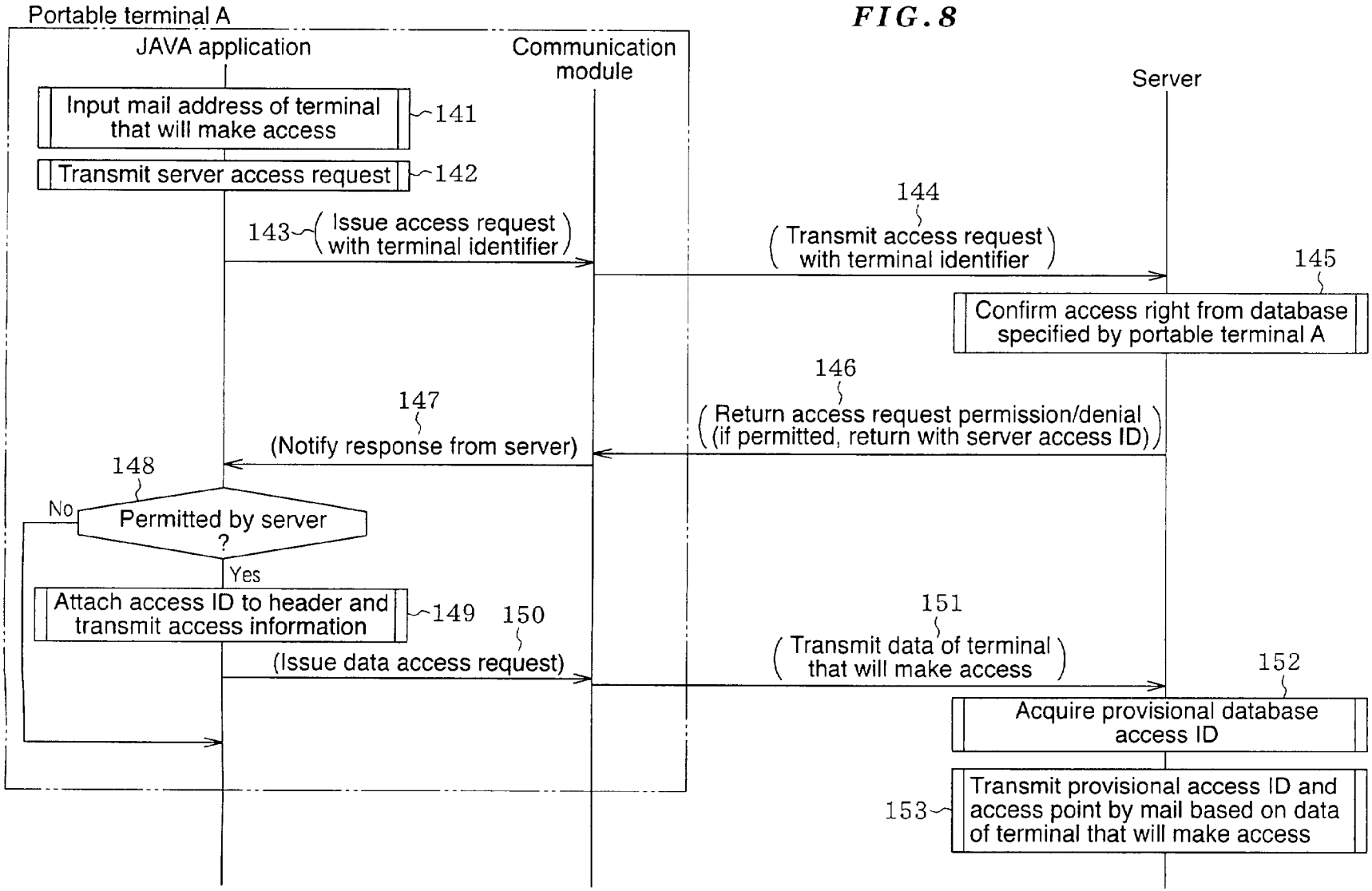
FIG. 8 is a sequence diagram showing operation for making the database of the voice sampling data possessed by the user accessible to other users in the voice synthesis system shown in FIG. 3.
Figure 9:
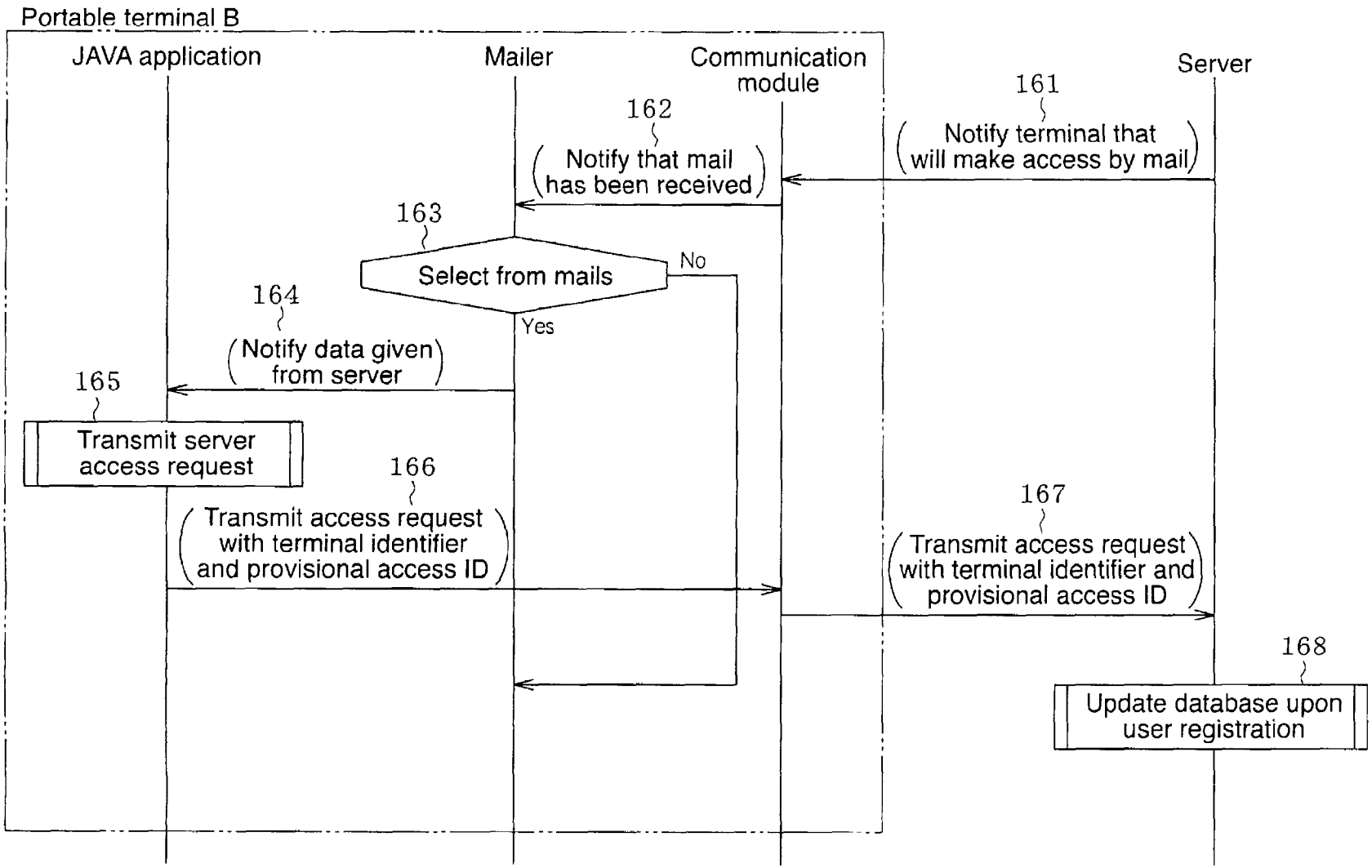
FIG. 9 is a sequence diagram showing operation for making the database of the voice sampling data possessed by the user accessible to other users in the voice synthesis system shown in FIG. 3.

FIGS. 8 and 9 are sequence diagrams showing operation for making the database of the voice sampling data possessed by the user accessible to other users. This operation will be described with reference to these figures.

First, a mail address of a portable terminal B who desires to access the database possessed by the user of the portable terminal A is input with the JAVA application of the portable terminal A (Step 141). Then, the mail address is sent to the server (Steps 142 to 144). Once the portable terminal A sends the mail address with a request to the server to allow access to the database of the user of the portable terminal A, the server issues and sends a provisional database access permission ID to the mail address of the portable terminal B with a database access point (server) (Steps 145 to 153).

When the portable terminal B receives the mail and the user of the portable terminal B selects the provisional database access permission ID on the mail screen, the provisional database access permission ID and the database access point (server) are given to the JAVA application by collaboration between the mailer and the JAVA application (Steps 161 to 164). By this operation, the JAVA application transmits the access identifier of itself and the provisional database access permission ID to the database access point (server) (Steps 165 to 167). Upon receiving the access identifier and the provisional database access permission ID, the server updates the database so that access from the portable terminal B is permitted from next time (Step 168).

According to the voice synthesis system and the voice synthesis method of the invention, voice sampling data of users of a plurality of portable terminals are stored in the server as databases. When text data transmitted from other portable terminal is transmitted to the server, the server returns the voice synthesis data generated based on the voice of the user who transmitted the text data. Therefore, the text data can be read out in the voice of the sender of the text data, thereby enhancing reality.

Each of the portable terminals may collect and transmit voice sampling data of the user to the server, which, in turn, produces databases based on the voice sampling data, thereby automatically and easily expanding the voice synthesis system. Accordingly, a user of a new portable terminal can join the voice synthesis system and immediately enjoy the above-described services.

In other words, according to the present invention, a text document sent by e-mail or like is converted into voice data according to user s selection so that it can be reproduced based on the voice data selected by the user and thus the user does not have to read the content of the document. Accordingly, the present invention can provide convenient use for sight disabled people.

The invention may be embodied in other specific forms without departing from the spirit or essential characteristic thereof. The present embodiments are therefore to be considered in all respects as illustrative and not restrictive, the scope of the invention being indicated by the appended Claims rather than by the foregoing description and all changes which come within the meaning and range of equivalency of the Claims are therefore intended to be embraced therein.

What is to be claimed:

1. A voice synthesis system comprising a plurality of portable terminals and a server which are connectable to each other via communication lines, wherein:

each of the portable terminals comprises a text data receiving unit for receiving text data from another portable terminal, a text data transmitting unit for attaching a voice sampling name to the received text data and transmitting the text data to the server, a voice synthesis data receiving unit for receiving voice synthesis data from the server, and a voice reproducing unit for reproducing the received voice synthesis data in a voice; and the server comprises a text data receiving unit for receiving the text data and the voice sampling name from the portable terminal, a voice synthesizing unit for converting the received text data into the voice synthesis data by using voice sampling data corresponding to the received voice sampling name, and a voice synthesis data transmitting unit for transmitting the converted voice synthesis data to the portable terminal, wherein the server converts the received text data into the voice synthesis data using voice data stored at the server corresponding to the received voice sampling name and not based on any voice information that may or may not have been sent along with the text data output from the another portable terminal to the portable terminal, wherein each of the portable terminals has a provisional database access permission ID assigned thereto by the server for use in storing voice data of a user of said each of the portable terminals, and wherein, when one of the portable terminals outputs the text data to another of the portable terminals, the one of the portable terminals includes the provisional database access right ID with the text data, which thereby enables the server to use voice data of the user of the another of the portable terminals in performing voice synthesis of the text data to be sent to the one of the portable terminals.

2. A voice synthesis system according to claim 1, wherein:

each of the portable terminals further comprises a voice sampling data collecting unit for collecting voice sampling data of each of a plurality of users, and a voice sampling data transmitting unit for transmitting the collected voice sampling data to the server; and the server further comprises a voice sampling data receiving unit for receiving the voice sampling data from each of the portable terminals, and a database constructing unit for attaching the voice sampling name to the received voice sampling data to construct a database that stores voice data of the plurality of users.

3. A voice synthesis method employed in a voice synthesis system comprising a plurality of portable terminals and a server which are connectable to each other via communicationlines, wherein:

each of the portable terminals performs a text data receiving step for receiving text data, a text data transmitting step for attaching a voice sampling name to the received text data and transmitting the text data to the server, a voice synthesis data receiving step for receiving voice synthesis data from the server, and a voice reproducing step for reproducing the received voice synthesis data in a voice; and the server performs a text data receiving step for receiving the text data and the voice sampling name from the portable terminal, a voice synthesizing step for converting the received text data into the voice synthesis data by using voice sampling data corresponding to the received voice sampling name, and a voice synthesis data transmitting step for transmitting the converted voice synthesis data to the portable terminal; and the server performs a converting step of converting the received text data into the voice synthesis data using voice data stored at the server corresponding to the received voice sampling name and not based on any voice information that may or may not have been sent along with the text data output from another portable terminal to the portable terminal, assigning, to each of the portable terminals, a provisional database access permission ID by the server for use in storing voice data of a user of said each of the portable terminals;

and wherein, when another of the portable terminals outputs the text data to one of the portable terminals, the method further comprising:

including, by the another of the terminals, the provisional database access right ID with the text data;

providing the provisional database access right from the one of the portable terminals to the server, along with the voice sampling name and the text data, wherein the server uses voice data of the user of the another of the portable terminals in performing voice synthesis of the text data to be sent to the one of the portable terminals, wherein, in the voice reproducing step for reproducing the received voice synthesis data in a voice, the text data is audibly played at the one of the portable terminals, to simulate the user of the another of the portable terminals speaking in accordance with the text data.

4. A voice synthesis method according to claim 3, wherein:

each of the portable terminals further performs a voice sampling data collecting step for collecting voice sampling data of each of a plurality of users, and a voice sampling data transmitting step for transmitting the collected voice sampling data to the server; and the server further performs a voice sampling data receiving step for receiving the voice sampling data from each of the portable terminals, and a database constructing step for attaching the voice sampling name to the received voice sampling data to construct a database.

5. A server used for voice synthesis system including a plurality of portable terminal terminals connected to the server, the server comprising:

a text data receiving unit for receiving text data and a voice sampling name from one of the portable terminals, a voice synthesizing unit for converting the received text data into voice synthesis data by using voice sampling data corresponding to the received voice sampling name, and a voice synthesis data transmitting unit for transmitting the converted voice synthesis data to the one of the portable terminals, wherein the voice synthesis data is created by the server based on the voice sampling name and the received text data received by the server, the server further comprises a voice sampling data receiving unit for receiving the voice sampling data from each of the portable terminals including the one of the portable terminals, and a database constructing unit for attaching the voice sampling name to the received voice sampling data to construct a database, wherein each of the portable terminals has a provisional database access right ID assigned thereto by the server for use in storing voice data of a user of said each of the portable terminals, and wherein, when the one of the portable terminals outputs the text data to another of the portable terminals, the one of the portable terminals includes the provisional database access right ID with the text data, which thereby enables the server to use voice data of the user of the another of the portable terminals in performing voice synthesis of the text data to be sent to the one of the portable terminals.

* * * * *